United States Patent [19]

Bunyea et al.

[11] 4,300,282

[45] Nov. 17, 1981

[54] FREE STANDING INSERTION TOOL

[75] Inventors: John R. Bunyea, Kernersville; Jess B. Ferrill, Greensboro; Ray A. J. Hutchinson; Ronald G. Sergeant, both of Winston-Salem, all of N.C.

[73] Assignee: AMP Inc., Harrisburg, Pa.

[21] Appl. No.: 67,076

[22] Filed: Aug. 16, 1979

[51] Int. Cl.[3] ..... H01R 43/04

[52] U.S. Cl. ..... 29/751; 29/566.4; 173/15; 173/117; 227/7

[58] Field of Search ..... 29/741, 753, 758, 764, 29/845, 739, 861, 866, 751, 752, 754, 566.4; 173/117-120, 13, 15, 16; 227/7, 131

[56] References Cited

U.S. PATENT DOCUMENTS

| | | | |
|---|---|---|---|
| 2,398,392 | 4/1946 | Page | 81/52.3 |
| 2,967,302 | 1/1961 | Loveless | 173/117 |
| 3,209,180 | 9/1965 | Doyle | 227/131 X |
| 3,327,623 | 6/1967 | Diegel | 173/117 |
| 3,436,121 | 4/1969 | Cunningham | 173/117 X |
| 3,453,463 | 1/1969 | Wildi | 310/27 |
| 3,802,516 | 4/1974 | Speicher | 173/15 |
| 3,898,724 | 8/1975 | Conorich | 29/566.4 |
| 4,015,671 | 4/1977 | Mikhailovich et al. | 173/117 |

*Primary Examiner*—Carl E. Hall
*Attorney, Agent, or Firm*—Gerald K. Kita

[57] ABSTRACT

An electrically operated tool is disclosed for inserting one or more insulated electrical wires into a barrel shaped, slotted terminal. A modified solenoid provides a hammer action power stroke which is initiated by partially retracting the toolhead inwardly of the tool upon movement of the tool against the barrel terminal. A trigger circuit applies line voltage to the solenoid windings, saturating the core, to provide rapid power stroke, so that the solenoid armature hammers against a strike plate of the toolhead. The trigger circuit includes a high and low power adjustment.

5 Claims, 10 Drawing Figures

FREE STANDING INSERTION TOOL

FIELD OF THE INVENTION

The present invention relates to a power tool for inserting insulated wires into an electrical terminal of the slotted beam or plate type. The terminal must be sufficiently robust to withstand the forces applied by the tool, and should be free standing, or in some other capacity, accessible by the tool.

BACKGROUND OF THE INVENTION

A slotted barrel terminal is disclosed in U.S. Pat. No. 4,141,618, wherein one or more electrical wires are electrically connected in a wire receiving slot of the terminal. There has been a need for a semiautomatic tool developing sufficient power for inserting one or more wires into the barrel slot. Further, a need has existed for a tool in which the power is adjustable to insert the terminal itself into a circuit board, in preparation of a subassembly suitable for connecting wires from terminal to terminal, and thereby, from point to point on the circuit board. The above identified terminal is especially suitable for use in conjunction with the tool according to the present invention, since the terminal is free standing and accessible to the tool, and since the terminal is sufficiently robust to absorb the energy of the tool power stroke, which may be adjusted suitably to drive the terminal into a circuit board, or to insert one or more wires along the slot and into electrical connection with the terminal.

SUMMARY OF THE INVENTION

The tool according to the present invention utilizes a modified solenoid and a trigger circuit which applies line voltage to the solenoid windings, saturating the same with a short duration current surge, with voltage in excess of maximum rated voltage of the solenoid, so that the solenoid armature delivers a short impulse, hammer stroke against a strike plate of a toolhead. As a safety feature, the toolhead must be depressed inwardly of the tool, against the resistance provided by a biasing spring. Once the spring resistance is overcome, the toolhead will engage an electrical switch which activates the trigger circuit. The circuit has an adjustment for regulating the power delivered by the solenoid. By this adjustment, the tool is adapted for inserting one or more wires of different gauges into various sizes of the terminal, and for inserting the terminal itself into a circuit board.

OBJECTS

An object of the present invention is to provide an electrically operated tool for driving electrical terminals into a circuit board, and for inserting one or more wires into electrical connection within wire gripping jaws of the terminals.

Another object of the present invention is to provide an electrically driven tool which delivers line voltage to the windings of a solenoid, saturating the same with voltage in excess of maximum rated voltage of the solenoid, to deliver a rapid power stroke of the solenoid armature which may be adjusted to insert a slotted barrel terminal into a circuit board or to insert one or more wires of different gauges into the slot of a terminal of variable size.

Other objects and advantages of the present invention will become aparent from the following detailed description and the accompanying drawings.

DRAWINGS

DETAILED DESCRIPTION

Figure 1:
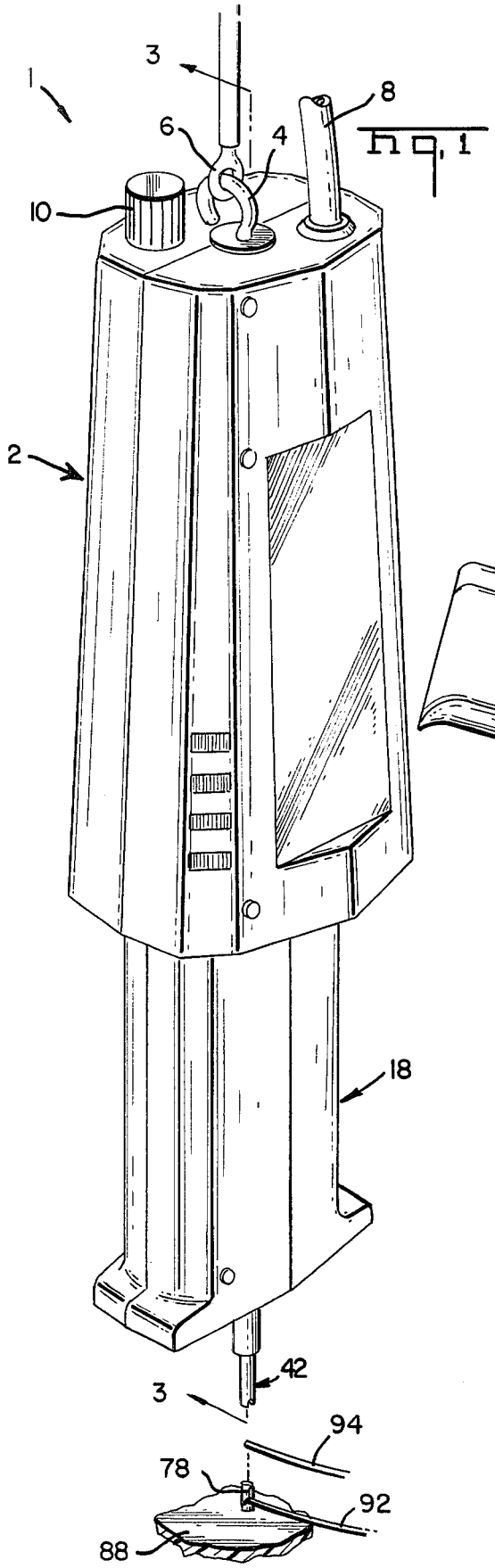
FIG. 1 is a front perspective of a tool according to the present invention.
Figure 2:
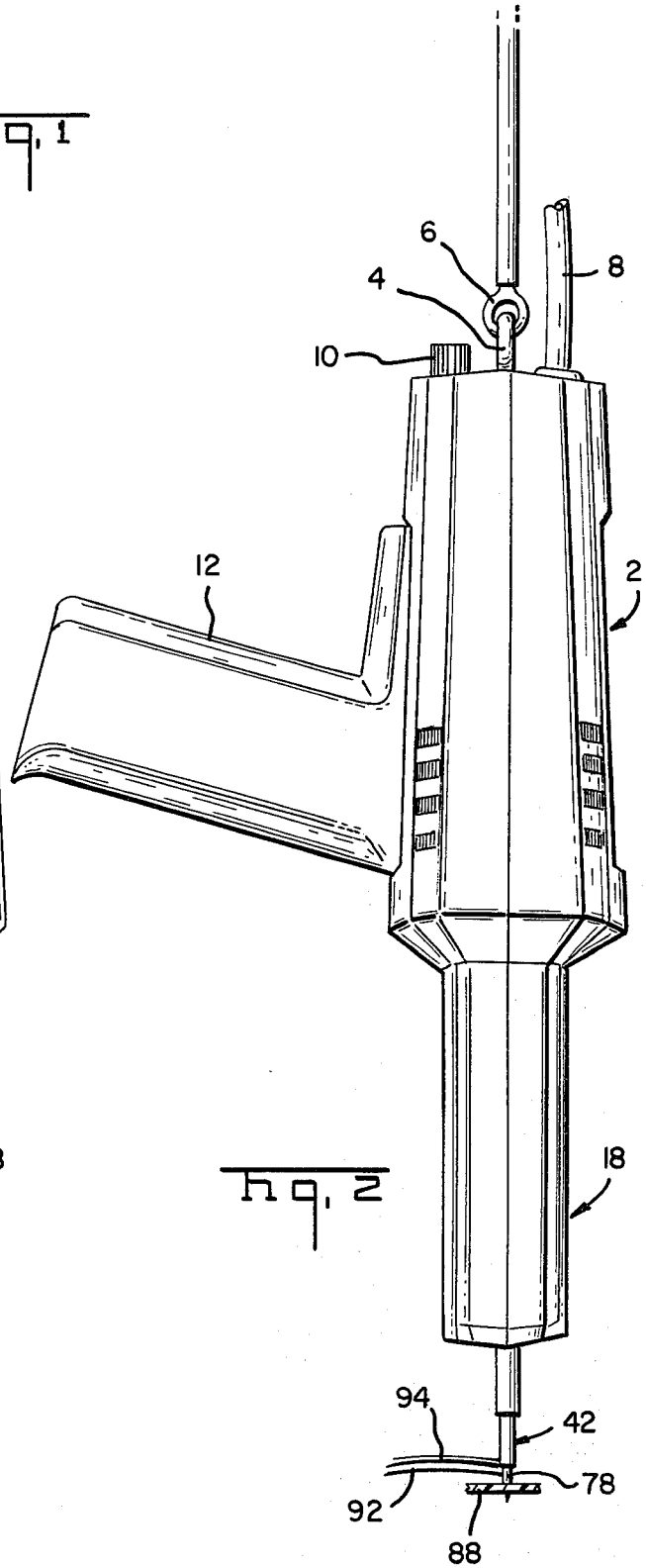
FIG. 2 is a reduced front elevation of the tool as shown in FIG. 1.

With more particular reference to FIG. 1 of the drawings, there is shown generally at 1 a preferred embodiment of a tool according to the present invention. The tool includes a housing 2 which is molded of any suitable, well known, plastics material. In a factory environment, the tool may be provided with an eye hook 4 which may be hooked to a clevis 6 of an overhead tool support reel or a spring. An electrical power cord 8 enters the tool for supplying electrical power to the trigger circuit, the details of which will be discussed. Also, operative upon the circuit, is a manually shiftable switch 10 for adjusting the power output of the tool. As shown in FIG. 2, the tool housing is provided with a detachable molded pistol type grip 12 for optional use by an operator of the tool.

Figure 3:
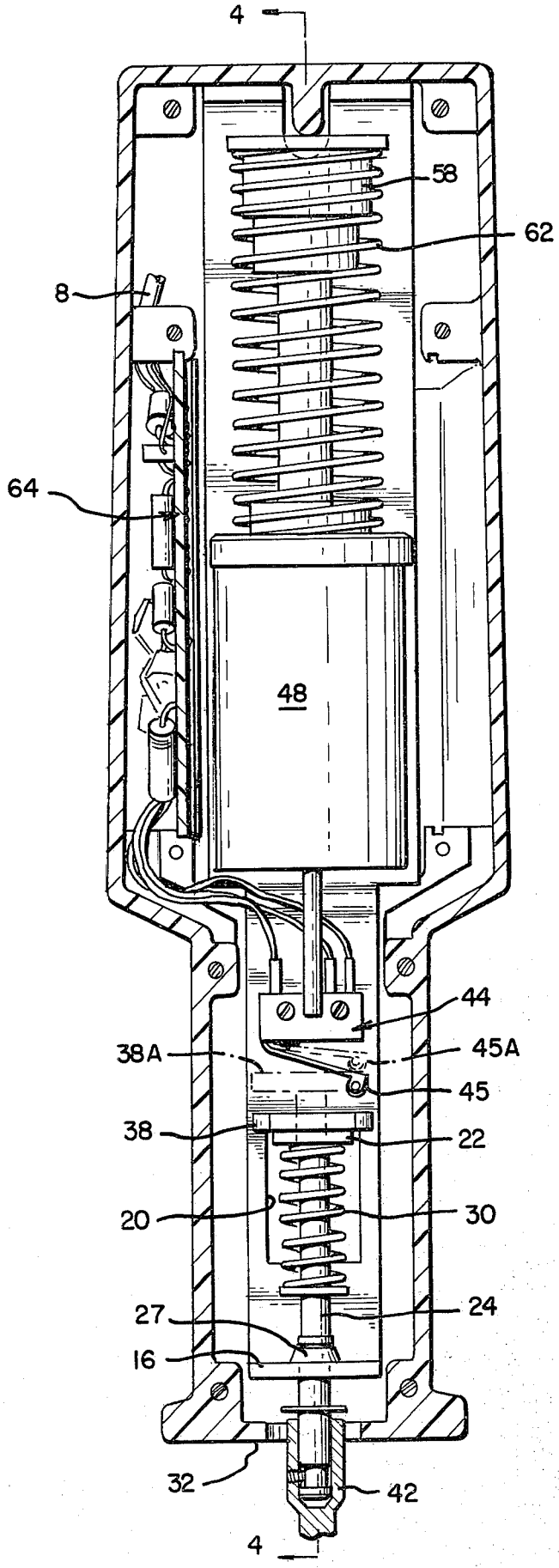
FIG. 3 is an enlarged section taken generally along the line 3—3 of FIG. 1.
Figure 4:
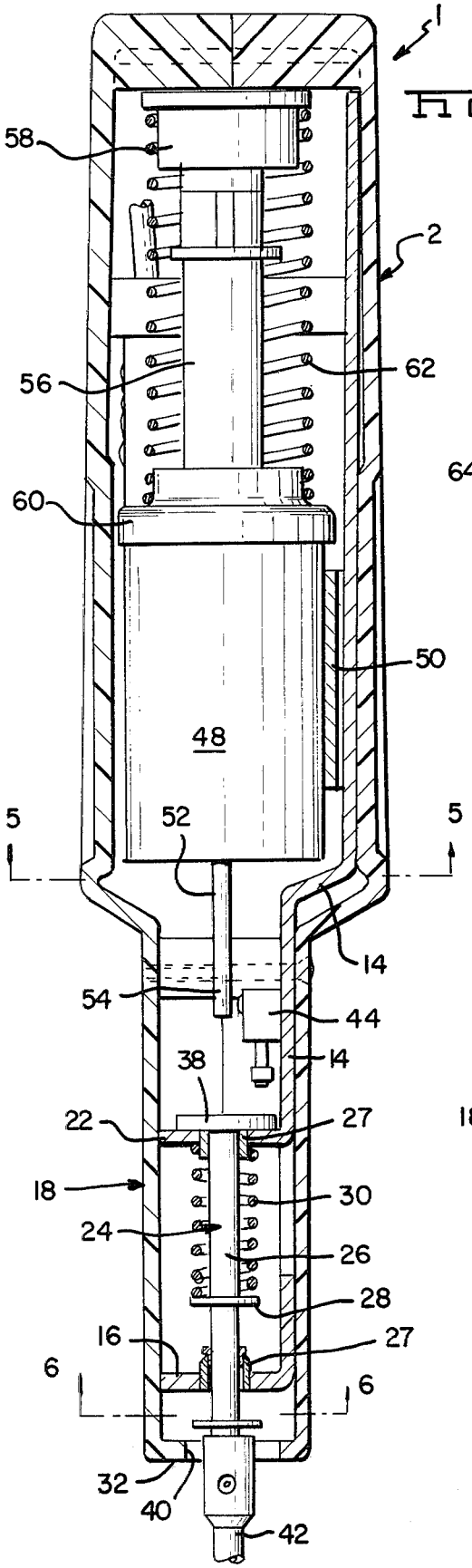
FIG. 4 is a section taken generally along the line 4—4 of FIG. 3.
Figure 5:
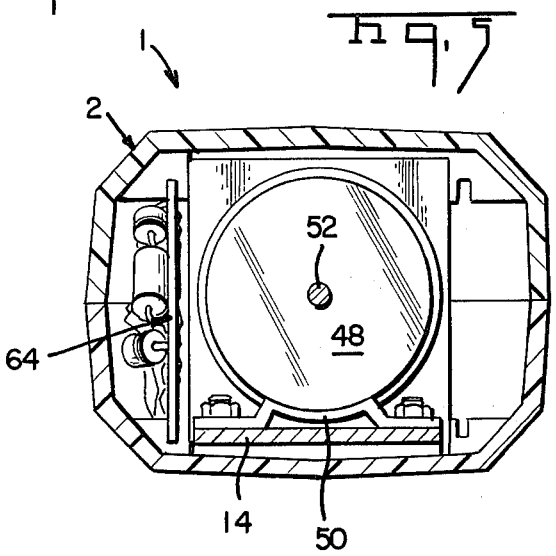
FIG. 5 is a section taken generally along the line 5—5 of FIG. 4.
Figure 6:
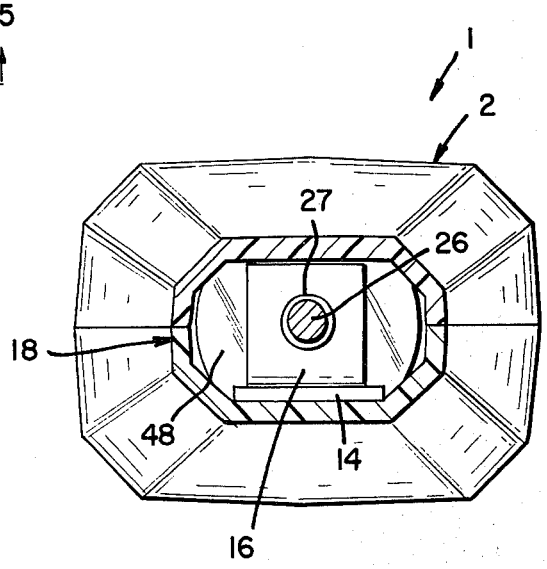
FIG. 6 is a section taken generally along the line 6—6 of FIG. 4.

Further details of the tool are shown in FIGS. 3 and 4, in which the housing contains an elongated metal strap 14 which extends lengthwise of the housing interior, and which is bent to conform with the inner periphery of the interior. One end of the strap is bent transversely of its length to provide a first flange 16, extending generally across the interior of the housing at a portion of reduced cross section, indicated generally at 18. Nearby, a window opening is provided at 20, as the result of fabricating a second flange 22 which is cut partially out of the strap and bent outwardly, leaving the window opening. The second flange 22 projects transversely across the interior of the housing section 18, spaced from the flange 16. The flanges 16 and 22 mount a toolhead, shown generally at 24, which includes a shaft 26, secured in bushings 27 of a suitable wear resistant, and low friction coefficient, material slidably supported in bores through the flanges 16 and 22. Between the flanges 16 and 22, the shaft is provided with a snap ring 28, and an encircling compression coil spring 30, the ends of which engage against the snap ring 28, and against the flange 22, to bias the shaft toward and outwardly of an end wall 32 of the housing portion 18. One end of the shaft is secured to a strike plate 38 which seats against the flange 28, and is constrained to move together with the shaft 26. The other end of the shaft 26 projects outwardly of an aperture 40 in the wall 32 and is provided with a tip 42 which is essentially an inserter, as described more particularly in FIGS. 8–10.

Figure 7:
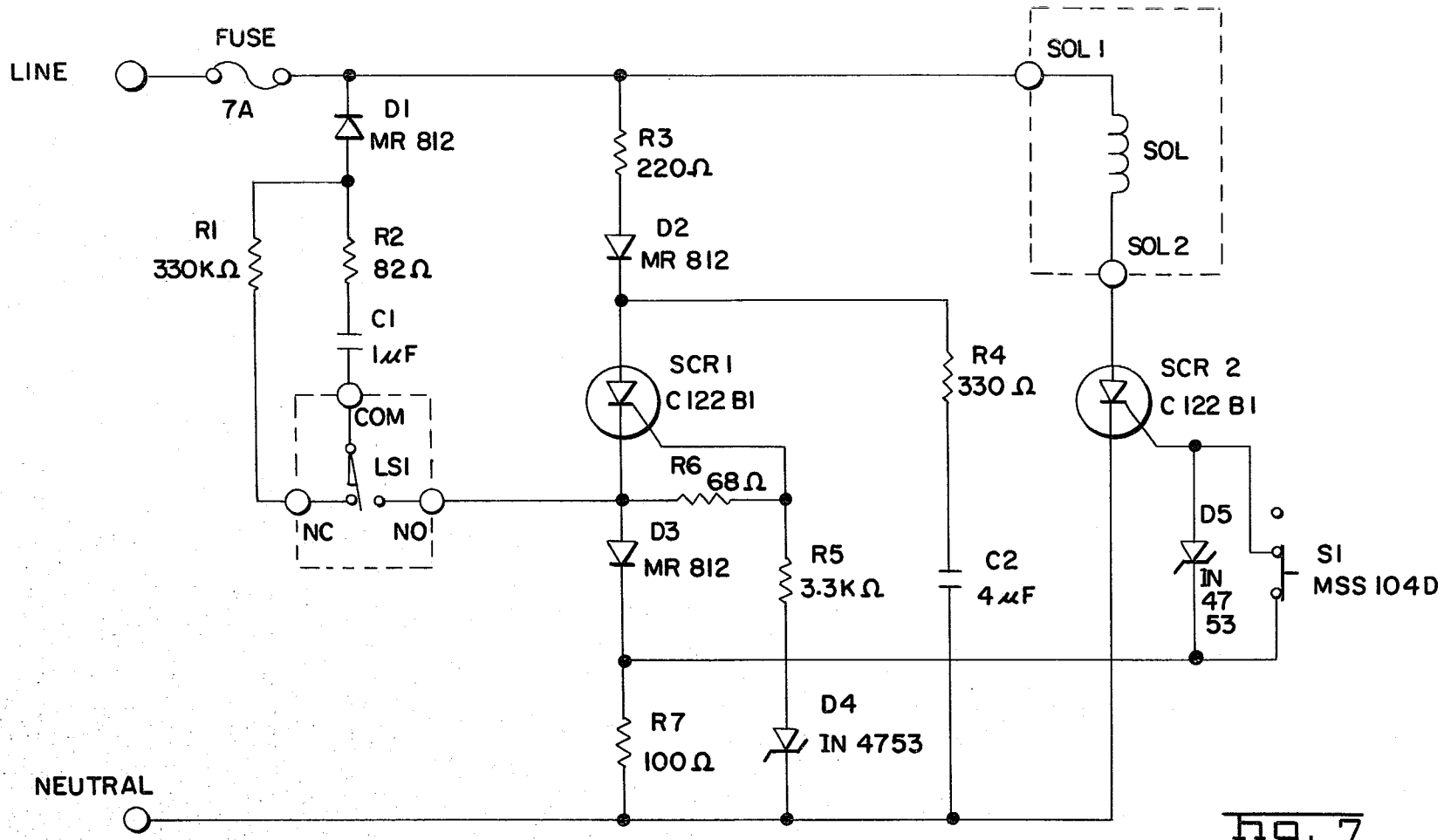
FIG. 7 is a schematic of a trigger circuit delivering electrical power to the tool.

Yet with reference to FIGS. 3 and 4, adjacent the strike plate 38 is located a miniature lever action electrical switch 44, mounted on the strap 14. In an enlarged portion 46 of the housing 2 is mounted an electrical solenoid 48 secured to the strap 14 by a hold down plate 50. The armature 52 of the solenoid is modified to include a reduced tip portion 54 which is axially aligned with the shaft 24, and which projects out one end of the solenoid windings directly opposite the strike plate and initially spaced therefrom. The armature further includes a thickened portion 56 which projects out the other end of the solenoid windings, and which is secured to a radially enlarged spring retainer plate 58. A cap 60 of stepped diameter is secured to the end of the solenoid. A coil spring 62 encircles the armature portion 56 and is captivated between the cap and the spring retainer. Also included in the housing 2 is a circuit board 64 on which are mounted electrical circuit devices, the schematic diagram and electrical values of which are shown in FIG. 7.

Figure 8:
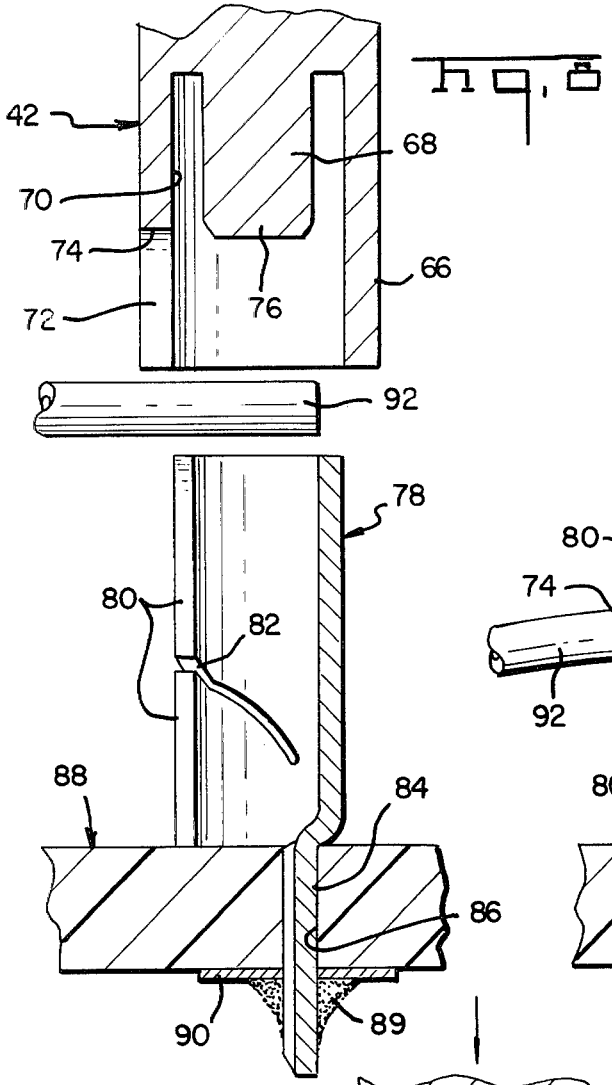
FIGS. 8–10 are enlarged fragmentary elevations illustrating operation of the toolhead.
Figure 9:
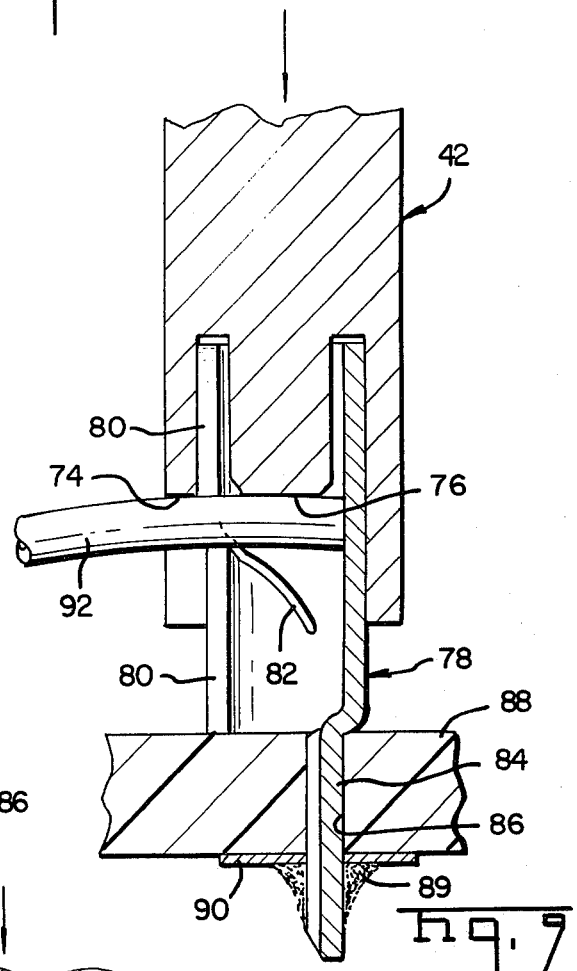
Figure 10:
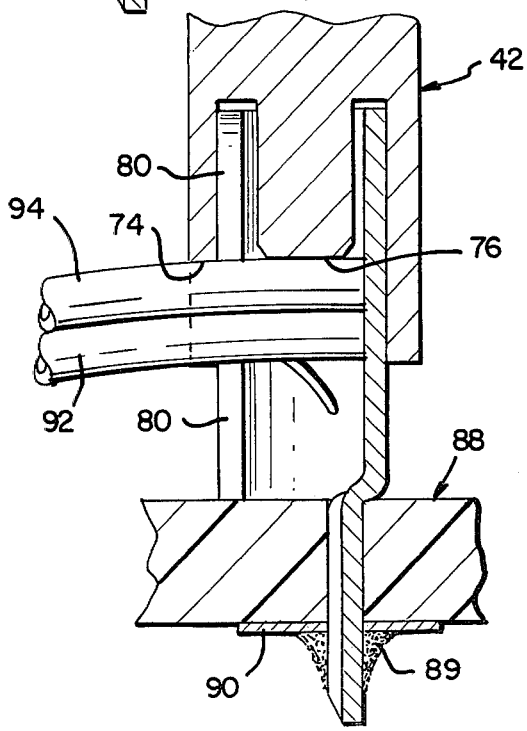

The details of the tool tip 42 are shown in FIGS. 8–10, wherein the tip 42 is machined with a cylindrical, open end, sleeve portion 66 and a central boss 68 which provides a wire stuffer. An annular space 70 is provided between the sleeve portion and the stuffer. A slot 72 is cut through one side of the sleeve portion and terminates in an end wall 74 coplanar with the end wall 76 of the stuffer.

A cylindrical barrel shaped terminal, shown generally at 78, of the type disclosed in U.S. Pat. No. 4,141,618, includes a wire receiving slot 80, divided by a transverse slot 82 into two sets of wire gripping jaws on opposite sides of the slot 80. The terminal includes a base 84 which projects through an aperture 86 of a printed circuit board 88, and which is soldered at 89 to a printed circuit 90 on the inverted surface of the board.

FIG. 8 shows an end of an insulation covered conductor 92 desired to be terminated electrically to the terminal. The end of the conductor is first located against the end of the terminal, in alignment with the slot 80 of the terminal. The tool head is then positioned over the terminal as shown in FIG. 1. As the tool is displaced vertically downward while over the terminal, the toolhead 42 engages the positioned wire and is slidably displaced inwardly of the tool. As shown in FIG. 3, the shaft 24 will retract inwardly of the housing compressing the coil spring 30. The strike plate 38 then will be moved to a position shown in Phantom outline at 38A, engaging and then pivoting the lever 45 of the switch 44 to a position shown in phantom outline at 45A. In the well known operation of a lever actuated switch, pivoting of the lever 45 triggers the control circuit, which applies current to the solenoid windings. The armature 52 is then impelled by solenoid actuation, forcibly striking the strike plate 38, and slidably driving the shaft 24 in a direction outwardly of the tool housing 2. The toolhead mounted on the shaft 24, is then thrust vertically toward the terminal, providing a wire insertion stroke. As shown in FIG. 9, the stroke is utilized to drive the wire, laterally of its length, into and along the slot 80 of the terminal. The wire gripping jaws of the terminal will slice through the insulation on the wire and compressively engage opposite sides of the conductor exposed by slicing the insulation. During the insertion stroke, the stuffer enters the open end of the terminal, while the terminal is concentrically supported and encircled by the sleeve portion of the toolhead. The spring retainer 58 will be impelled together with the armature, compressing the coil spring 62 and storing resilient spring energy. Subsequent to solenoid actuation, the stored energy expands the spring and returns the armature to its initial position. Similarly, the spring 30 in its relaxed position will maintain the shaft and toolhead 42 at their initial positions. The spring rate of the spring 30 is selected to require four pounds of force to retract the shaft 24, preventing premature or unsafe actuation of the solenoid.

When an additional wire is to be inserted and connected electrically to the terminal, the above procedure is repeated. More specifically, FIG. 10 shows an additional wire 94, engaged by the toolhead 42, and inserted thereby into and along the slot 80 of the terminal. The toolhead stuffer 68 enters the open end of the terminal, urging the additional wire 94 along the slot, using the wire 94 to push the wire 92 further along the slot for connection between the tandem set of jaws. The trigger circuit is provided with a high or low adjustment for selecting the power output of the tool stroke to correspond with the gauge of the wire or wires being inserted, and with the size of the terminal in which the wire or wires are to be inserted. As an added feature of the invention, the tool may be used for inserting the terminal into the aperture of the circuit board. Since the terminal open end is encircled by the tool sleeve portion, and since the stuffer enters the terminal free end, the cylindrical wall of the barrel configuration is supported on both sides against buckling. The trigger circuit may be adjusted by the switch 10 to deliver an insertion force sufficient for insertion of the terminal into the circuit board without damaging the terminal or the board.

With reference to FIG. 7, operation of the circuit will be described. With the switch (LS1), corresponding to the switch 44, in the normally closed position, capacitor (C1) is discharged through its timing resistors (R1 and R2). When the line side is in its positive half cycle, capacitor (C2) is charged through resistors (R3 and R4), and diode (D2). Both SCR's are off having seen no gate current. During the negative half cycle, no current can flow in the circuit due to the blocking diodes (D2 and D3). If switch (LS1) is switched to the normally open position, the positive half cycle has no effect other than keeping C2 fully charged. However, when the negative half cycle voltage excedes the breakdown voltage of zenier diode (D4), (36 volts), capacitor (C1) begins to charge through diodes (D1 and D4), resistors (R2 and R6), and switch (LS1). The voltage drop across resistor (R6) causes current to flow from the gate to the cathode of SCR1. Because capacitor (C2) is holding the anode of SCR1 positive with respect to its cathode, SCR1 is turned on and held on by the holding current supplied by C2. The voltage drop across R7 causes a current flow from the gate to the cathode of SCR2 setting up conditions for it to conduct as soon as its anode voltage goes positive. As the next positive half cycle reaches the line side, SCR2 conducts through the solenoid permitting the full half cycle of energy to be used by the solenoid. The following negative half cycle reverse biases both SCRS (C2 is now discharged) turning them both off. By now, capacitor (C1) is fully charged and can no longer supply gate current to (SCR1) whether or not switch (LS1) is in the normally open position. Releasing switch (LS1) discharges capacitor (C1) through its timing resistors (R1 and R2). The circuit can not be refired until C1 is almost completely discharged and is capable of supplying the necessary gate current to SCR1.

Switching zenier diode (D5) into the circuit, by actuating S1 by the knob 10, causes SCR2 to fire at some point late in the positive half cycle reducing the available energy to the solenoid.

Although a preferred embodiment of the present invention has been described and shown in detail, other modifications and embodiments which would be apparent to one having ordinary skill in the art are intended to be covered by the spirit and scope of the claims.

What is claimed is:

1. In a force applying tool having a toolhead and a solenoid for driving the toolhead, the improvement comprising:

A first coil spring encircling said toolhead and being in compression upon movement of said toolhead toward said solenoid, a first switch actuated by said toolhead movement toward said solenoid to actuate said solenoid, a trigger circuit coupled between said first switch and said solenoid to provide discharge of voltage to windings of said solenoid in excess of maximum rated voltage of said solenoid, said toolhead includes a strike plate initially spaced from said solenoid armature and said first switch, means in said case for limiting outward displacement of said toolhead, said circuit includes a first capacitor coupled to said source through a first diode and coupled in parallel with a first resistor through a second switch in a first position, said circuit further includes an auxiliary first SCR having its anode coupled to said source through a second diode, and coupled to neutral potential through a second capacitor, said second capacitor being coupled to said source through said second diode, said first SCR having its gate coupled to its cathode through a second resistor and coupled to neutral potential through a Zener diode, said first SCR having its cathode coupled to neutral potential through a third diode and a third resistor, and said circuit further includes a second SCR having its anode coupled to said solenoid windings and its cathode coupled to neutral potential, said second SCR having its gate coupled by said first switch to the junction of said third diode and said third resistor, said second switch in a second position connecting said first capacitor to neutral potential through said Zener diode and connecting said first capacitor to said cathode of said first SCR and to the gate of said first SCR through said second resistor, said toolhead is displaced in a direction inwardly of said case to engage and actuate said first switch and to move said strike plate away from said means, said solenoid is actuated by said first switch to propel said solenoid plunger into said strike plate and propel said toolhead forcibly outward, and provide a tool stroke for inserting one or more insulated wires into and along a wire receiving and gripping slot of an electrical terminal.

2. In a force applying tool having a case, a toolhead, a solenoid and a circuit for discharging current from an A.C. source through a first switch in series with windings of said solenoid to drive an armature of said solenoid against said toolhead, characterized in that:

said circuit includes a first capacitor coupled to said source through a first diode and coupled in parallel with a first resistor through a second switch in a first position, said circuit further includes an auxiliary first SCR having its anode coupled to said source through a second diode, and coupled to neutral potential through a second capacitor, said second capacitor being coupled to said source through said second diode, said first SCR having its gate coupled to its cathode through a second resistor and coupled to neutral potential through a Zener diode, said first SCR having its cathode coupled to neutral potential through a third diode and a third resistor, said circuit further includes a second SCR having its anode coupled to said solenoid windings and its cathode coupled to neutral potential, said second SCR having its gate coupled by said first switch to the junction of said third diode and said third resistor, and said second switch in a second position connecting said first capacitor to neutral potential through said Zener diode and connecting said first capacitor to said cathode of said first SCR and to the gate of said first SCR through said second resistor.

3. The structure as recited in either claim 1 or 2, and further including, a Zener diode in parallel with said first switch.

4. The structure as recited in claim 2, wherein, said toolhead is constructed for engaging and actuating said second switch to its second position.

5. The structure as recited in either claim 1 or 2, wherein said toolhead is slideable in respect to said case to engage and actuate said second switch to its second position.

* * * * *